US006099354A

United States Patent [19]

Troyan

[11] Patent Number: 6,099,354

[45] Date of Patent: Aug. 8, 2000

[54] PLANAR CONNECTOR

[75] Inventor: Bruce Robert Troyan, Lake Oswego, Oreg.

[73] Assignee: Tyco Healthcare Group LP, Mansfield, Mass.

[21] Appl. No.: 09/131,646

[22] Filed: Aug. 10, 1998

[51] Int. Cl.[7] ..... H01R 27/02

[52] U.S. Cl. ..... 439/638; 439/909

[58] Field of Search ..... 439/638, 653, 439/637, 79, 680, 692, 909

[56] References Cited

U.S. PATENT DOCUMENTS

| | | | |
|---|---|---|---|
| 2,398,996 | 4/1946 | Benander | 439/696 |
| 4,538,867 | 9/1985 | Wilson et al. | 439/680 |
| 4,850,899 | 7/1989 | Maynard | 439/653 |
| 4,932,885 | 6/1990 | Scholz | 439/79 |
| 5,584,708 | 12/1996 | Leong | 439/79 |

*Primary Examiner*—Gary F. Paumen

*Attorney, Agent, or Firm*—Brown, Rudnick, Freed & Gesmer, P.C.

[57] ABSTRACT

The present invention is directed to a connector and a system. The connector 100 includes a housing 105 having a first and a second end portion 110, 115, and a contact having a first and a second end portion. The connector further comprises a printed circuit board interface 120 and a second interface 125. The printed circuit board interface 120 is located adjacent the first end portion 110 of the housing 105, the printed circuit board interface 120 adapted to receive the first end portion of the contact. The second interface 125 is located adjacent the second end portion 115 of the housing 105 and adapted to mate with a plug connector 610, the second interface 125 having a second contact adapted to receive the second end portion 115 of the contact. The system 710, 910 comprises a mating plug connector 610 capable of mating with the connector 100.

4 Claims, 5 Drawing Sheets

PLANAR CONNECTOR

BACKGROUND OF THE INVENTION

1. Field of the Invention

This invention relates generally to electrical connectors, and, more particularly, to a planar connector for a printed circuit board (PCB).

2. Description of the Related Art

It is not uncommon to find electrical devices ranging from catheters to computers that have a printed circuit board (PCB) that can be plugged into a variety of connectors. Generally, a connector that attaches to a PCB of a device such as a catheter, microphone, or the like (hereinafter referred to as a "handpiece") is hardwired to a cable, which connects the handpiece to another electrical device, such as a controller, for example. Alternatively, cables that are not directly hardwired to the handpieces come equipped with an edge-card connector affixed to one end of the cable, which then attaches to the PCB of the handpiece.

Typically, to prevent contamination, handpieces utilized in the medical field are discarded after every use. Accordingly, a cable that is hardwired to a disposable medical handpiece will also be discarded along with the handpiece after use. A cable equipped with an edge-card connector, on the other hand, does not have to be discarded since it is possible to detach the edge-card connector from the PCB before discarding the handpiece. However, such a cable, at a minimum, would have to be sterilized for future use.

While the cables having edge-card connectors may not be discarded along with the handpiece after each use, they, however, suffer from other shortcomings. For example, the edge-card connectors generally have a short life span, thus requiring users to frequently replace the cables, including the accompanying connectors. Additionally, cables equipped with edge-card connectors are more difficult to autoclave, making sterilization a time consuming and/or expensive process.

Replacing the cables and connectors every time a medical handpiece is discarded is not only inconvenient, but it is also expensive. Thus, what is needed is a method and apparatus that is conveniently reusable, readily autoclavable, more durable, and less expensive.

The present invention is directed to overcoming, or at least reducing the effects of, one or more of the problems set forth above.

SUMMARY OF THE INVENTION

In one aspect of the present invention, a connector is provided that includes a housing having a first and a second end portion, and a contact having a first and a second end portion. The connector further comprises a printed circuit board interface located adjacent the first end portion of the housing, the printed circuit board interface adapted to receive the first end portion of the contact. The connector includes a second interface located adjacent the second end portion of the housing and adapted to mate with a plug connector, the second interface having a second contact adapted to receive the second end portion of the contact.

In another aspect of the present invention, a system is provided that includes a disposable connector comprising a housing having a first interface located on a first end portion of the housing and a second interface located on a second end portion of the housing. The system also includes a plug connector having a first and second interface, the first interface of the plug connector adapted to mate with the second interface of the connector, and the second interface of the plug connector capable of providing a transition to a cable.

BRIEF DESCRIPTION OF THE DRAWINGS

The invention may be understood by reference to the following description taken in conjunction with the accompanying drawings, in which like reference numerals identify like elements, and in which.

Figure 1:
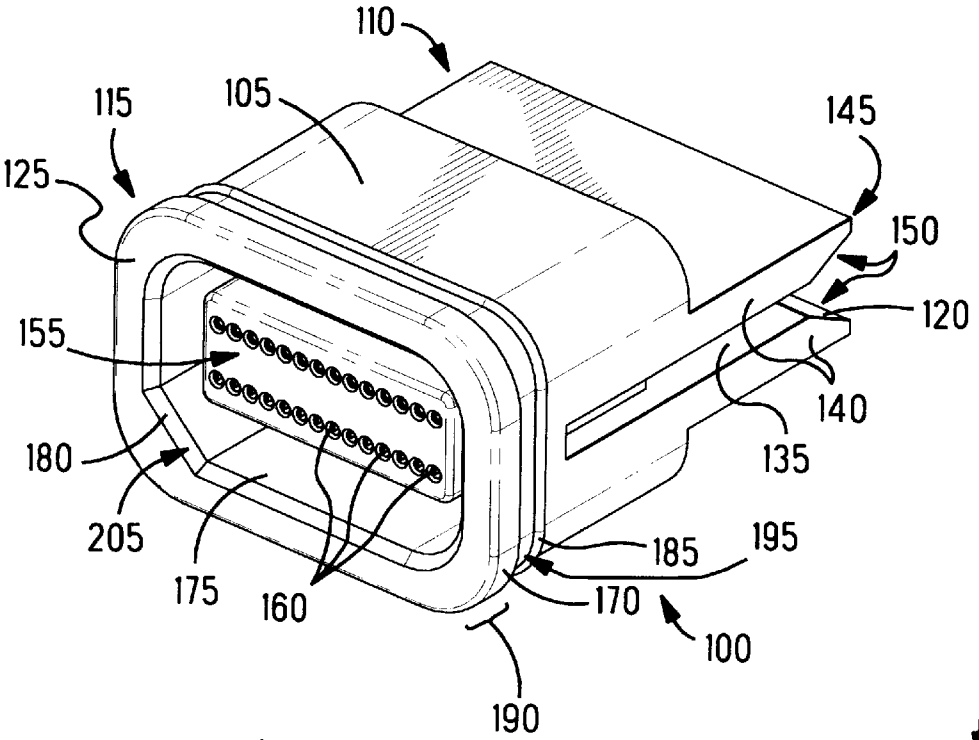
FIG. 1 is a front perspective view of a connector in accordance with the present invention.
Figure 2:
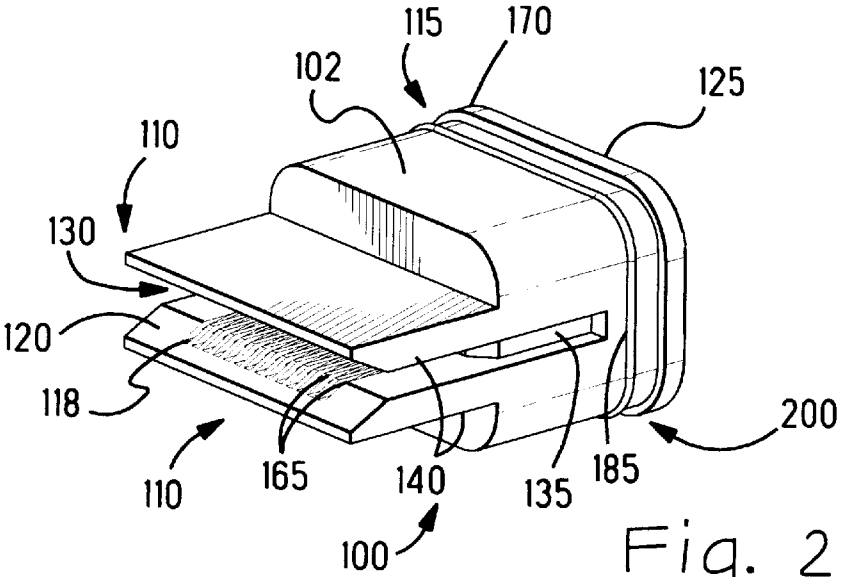
FIG. 2 is a rear perspective view of the connector of FIG. 1.
Figure 3:
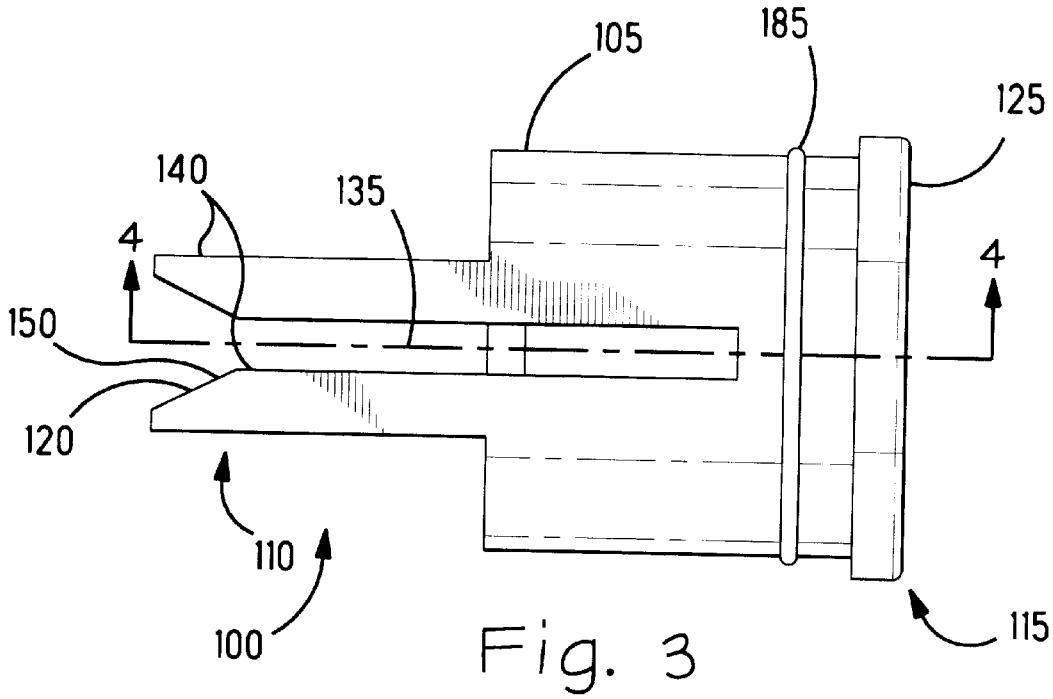
FIG. 3 illustrates a side view of the connector of FIG. 1.
Figure 4:
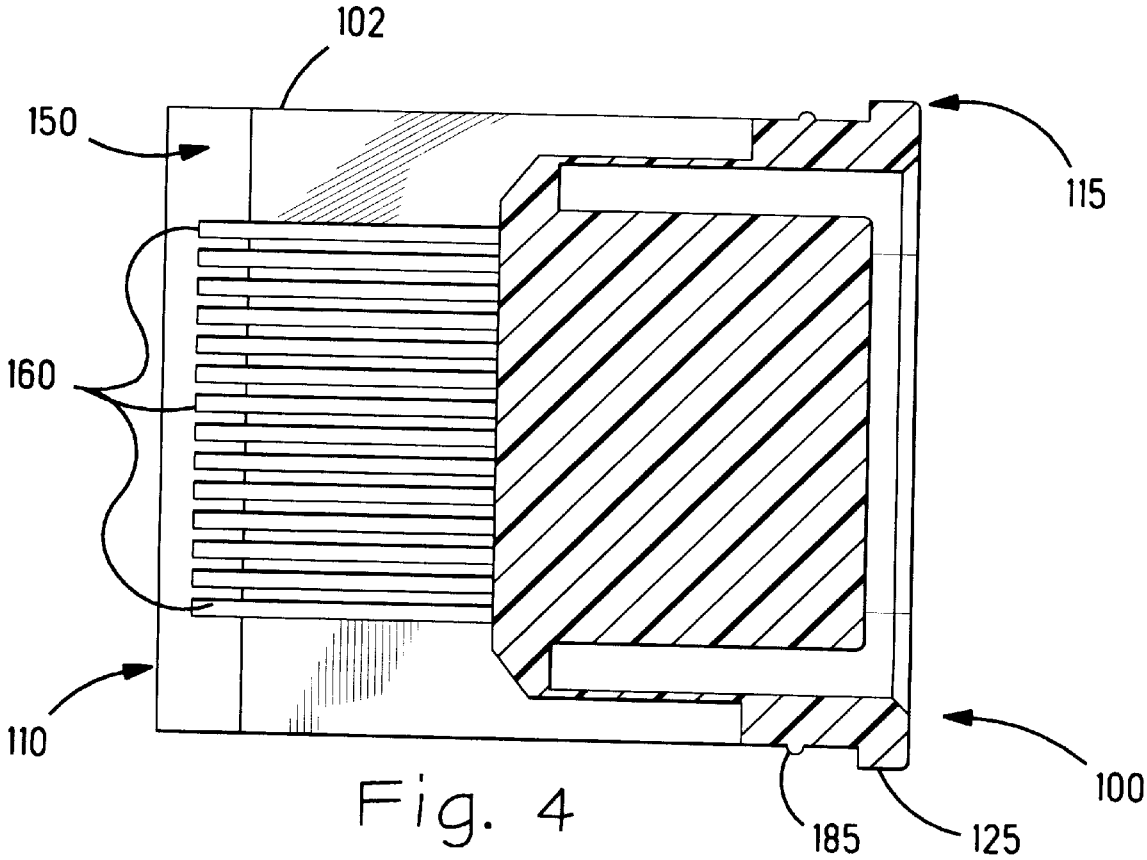
FIG. 4 depicts a top cross-sectional view of the connector of FIG. 1.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to the drawings, and in particular to FIGS. 1–6, a planar connector 100 is illustrated in accordance with the present invention. The planar connector 100 comprises a housing 105 having a first and a second end portion 110, 115, wherein a first interface 120 is located adjacent the first end portion 110 of the housing 105 and a second interface 125 is located adjacent the second end portion 115 of the housing 105. In one embodiment, in the interest of reducing the cost of manufacturing the connector 100, the housing 105 can be a one-piece molded housing.

The first interface 120 in the illustrated embodiment is a printed circuit board interface 120 comprising an edge-card connector 130 capable of receiving at least a portion of the printed circuit board (not shown). Conversely, in an alternative embodiment, the printed circuit board interface 120 may comprise a printed circuit board (not shown) (i.e., as opposed to a receptacle that receives a printed circuit board). In the aforementioned alternative embodiment, the printed circuit board would be capable of mating with a receptacle (not shown) adapted to receive the printed circuit board. Those skilled in the art will appreciate that a variety of intermediate connections, such as wires or adapters, may be utilized between the first interface 120 and its corresponding mating interface of the handpiece (not shown) without departing from the spirit and scope of the invention.

The housing 105 includes an alignment guide 135 that substantially aligns the first interface 120 with the printed circuit board (not shown). The alignment guide 135 includes a pair of outwardly extending arms 140 spaced apart by a dimension substantially corresponding to the thickness of the printed circuit board (not shown). The arms 140 have a distal end portion 145 where their distance apart varies. In the illustrated embodiment, the distal end portions 145 of the arms 140 extend away from one another at an angle in the range of about zero to sixty degrees. The angular end portions 145 of the arms 140 provide for self-alignment when the connector 100 is placed on a printed circuit board (not shown). That is, as the connector 100 is urged toward the printed circuit board, the angular end portions engage the printed circuit board and guide the printed circuit board into the narrow space between the arms 140.

Figure 5:
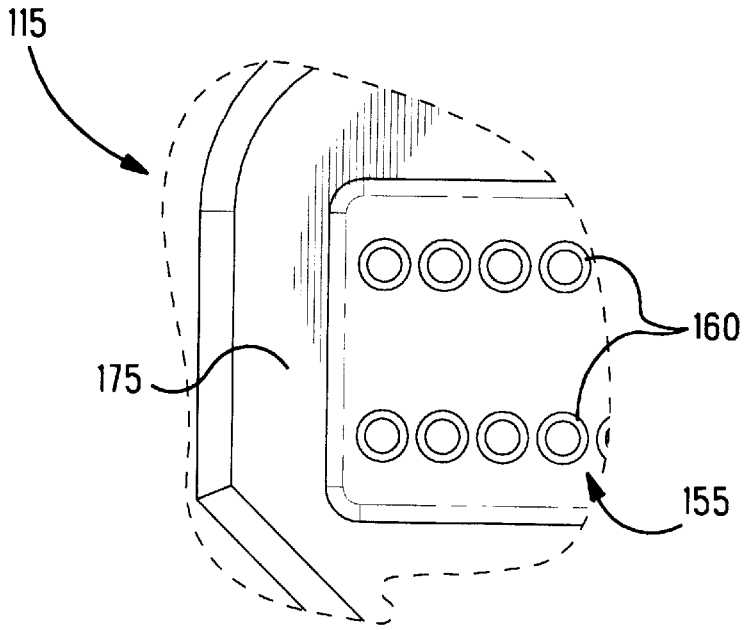
FIG. 5 illustrates an enlarged view of a second interface of the connector of FIG. 1.
Figure 6:
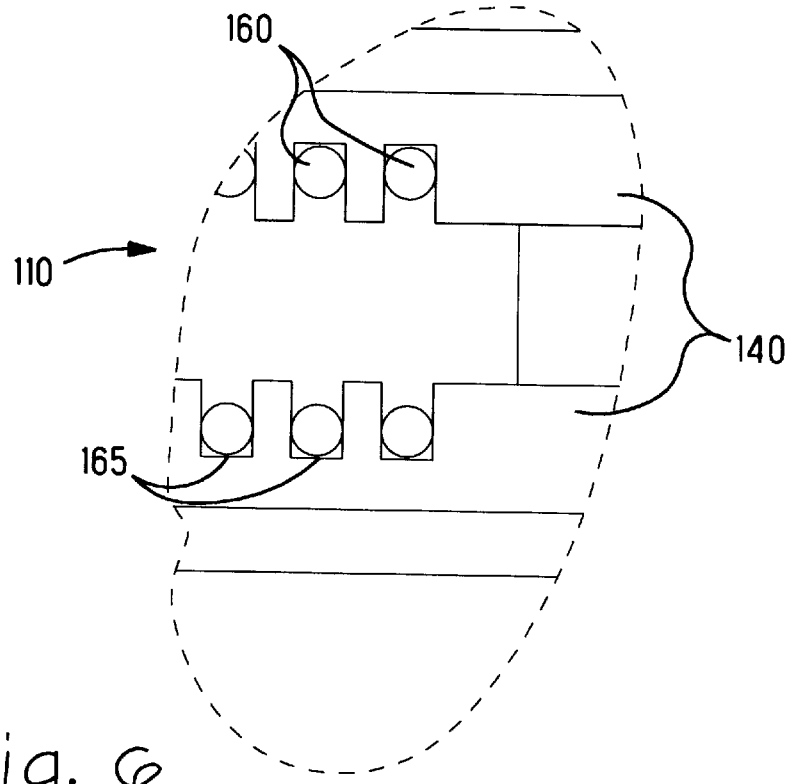
FIG. 6 illustrates an enlarged view of a first interface of the connector of FIG. 1.

The second interface 125 of the connector 100 in the illustrated embodiment provides a transition to a cable (not shown), for instance, such as a high-reliability cable. A high-reliability cable, for example, can be a cable that is sealed with potting and has solid pin contacts (not shown). The second interface 125 includes a contact cavity 155 that runs along a longitudinal axis of the connector 100 to the first interface 120. The contact cavity 155 in the illustrated embodiment comprises a plurality of stamped and formed receptacle-contacts 160 adapted to mate with circular pins of a mating plug connector (not shown) FIG. 5 shows an enlarged view of the receptacle-contacts 160.

The stamped and formed receptacle-contacts 160 are positioned in alignment channels 165, which are formed inside the housing 105 and run substantially parallel to each other between the two interfaces 120, 125. The formed contacts 160 are aligned and held in place in the alignment channels 165, which provide a bearing surface for the contacts 160, as can be seen more clearly in FIG. 6. The number, shape, size, as well as the placement, of the formed contacts 160 are matters of design choice, and hence may vary from one implementation to another. Those skilled in the art will appreciate that the contacts 160 at the second interface 125 may, in an alternative embodiment, comprise a plurality of outwardly protruding pins (not shown) capable of mating with a plurality of corresponding stamped and formed contacts (not shown) of the mating plug connector (not shown).

The housing 105 further includes a handle interface abutment 170, a plug interface housing 175, an alignment key 180, and a handle interface rib 185. The handle interface abutment 170, which is located adjacent the second end portion 115 of the housing 105, may be utilized in positioning the connector 100 into a mating handle (not shown) of a handpiece (not shown). The connector 100 is inserted into the handpiece with the printed circuit board interface 120 engaged with a printed circuit board within the handpiece. The second end portion 115 extends out from the handpiece to expose the second interface 125 for connection to additional devices. The handle interface 170 abutment is formed by sizing a portion 190 of the second end portion 115 of the housing 105 until the mating handle of the handpiece substantially brushes against an inner portion 195 of the handle interface abutment 170. Once the connector 100 is inserted into the handle of the handpiece, the abutment 170 provides a finished detail and interface to the handpiece (not shown).

The connector 100 is secured to, and thereafter retained in, the handpiece by the handle interface rib 185. The handle interface rib 185, which is located adjacent the inner portion 195 of the handle interface abutment 170, is formed by sizing a portion 200 of the housing 105 such that the mating handle securely snaps onto the interface rib portion 200. The circumference of the interface rib 185 is selected to be slightly greater than a corresponding opening in the mating handle, so that an interference fit exists between the mating handle and the interface 185. As illustrated, the interface abutment portion 190 is larger than the rib portion 200, allowing the mating handle (not shown) to rest flush against the inner portion 195 of the handle interface abutment 170 once the connector 100 is positioned inside the handpiece (not shown).

The plug interface housing 175 is recessed into the second end portion 115 of the housing 105. The shape of the plug interface housing 175 corresponds to the shape of the mating plug (not shown) so that the mating plug can be positively aligned with the connector 100. The alignment key 180 is formed by making the plug interface housing 175 asymmetric so that the mating plug connector (not shown) can be inserted in only a single orientation. In the illustrated embodiment, the alignment key 180 is formed by removing a portion 205 of a corner of the plug connector and the plug interface housing 175. Those skilled in the art will appreciate that the number, shape, location, and size of the alignment key 180 are matters of design choice.

Figure 7:
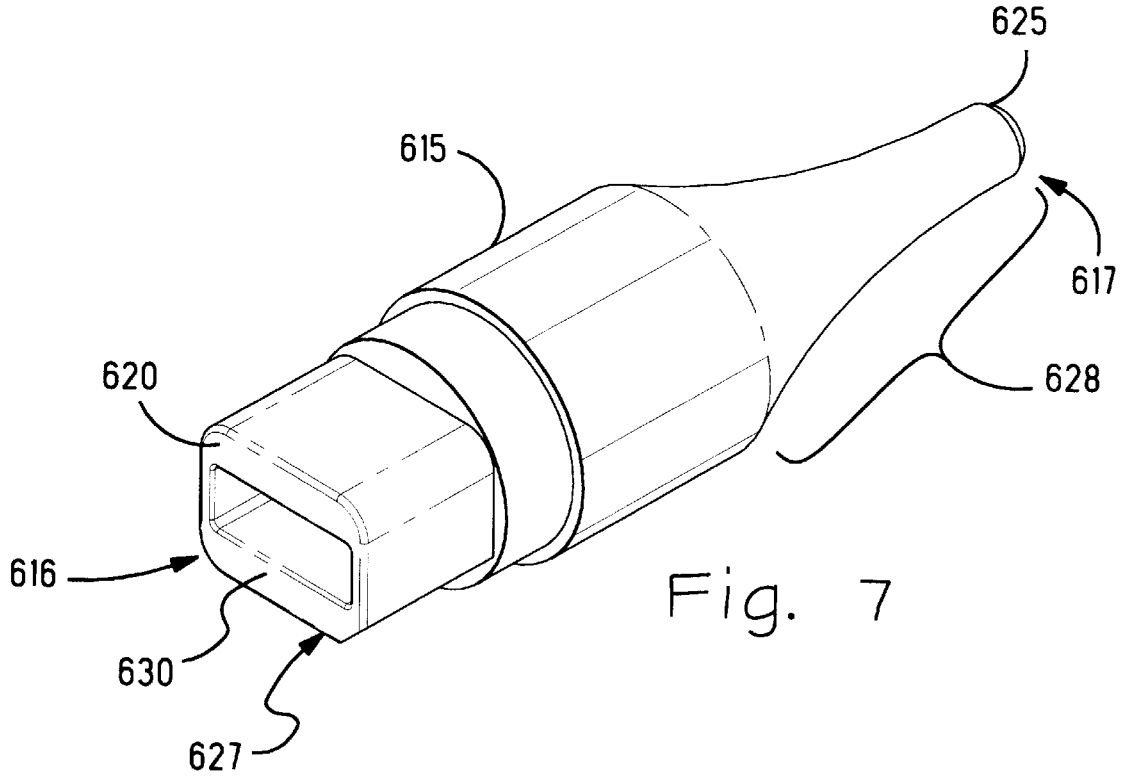
FIG. 7 illustrates a mating plug connector capable of mating with the connector of FIG. 1 in accordance with the present invention.
Figure 8:
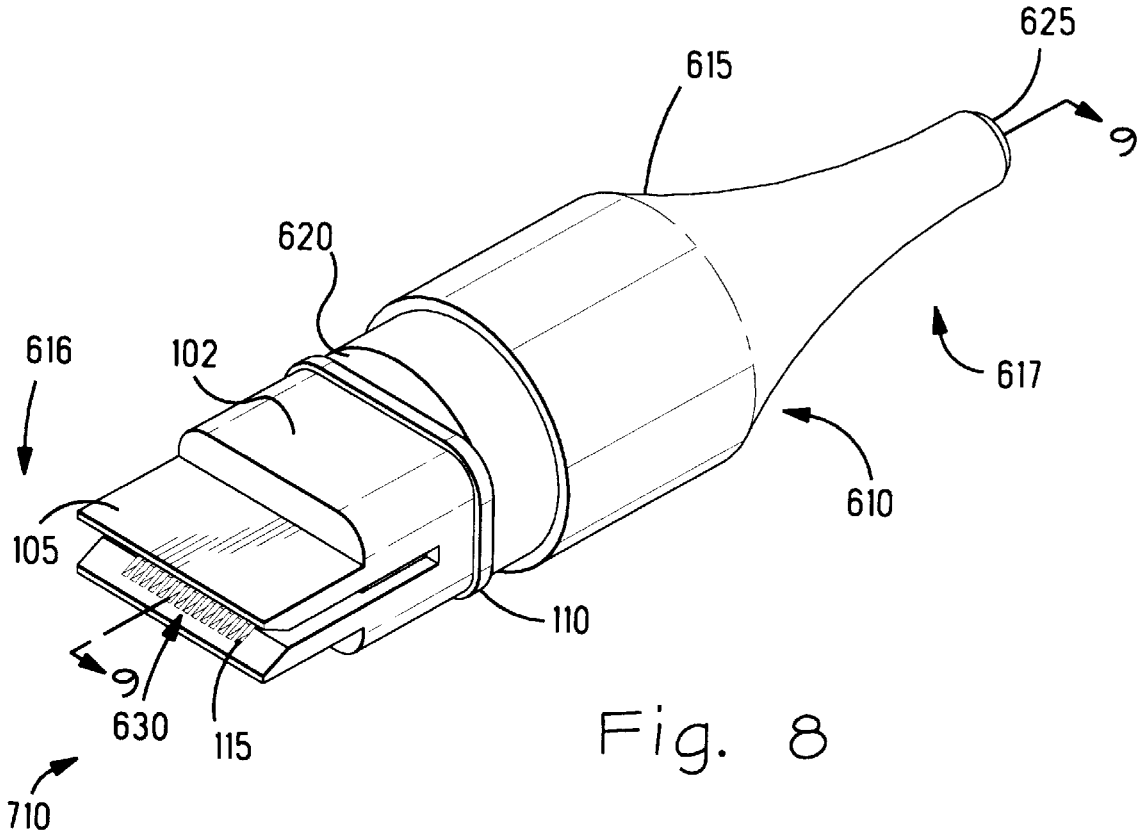
FIG. 8 illustrates a system in accordance with the present invention.
Figure 9:
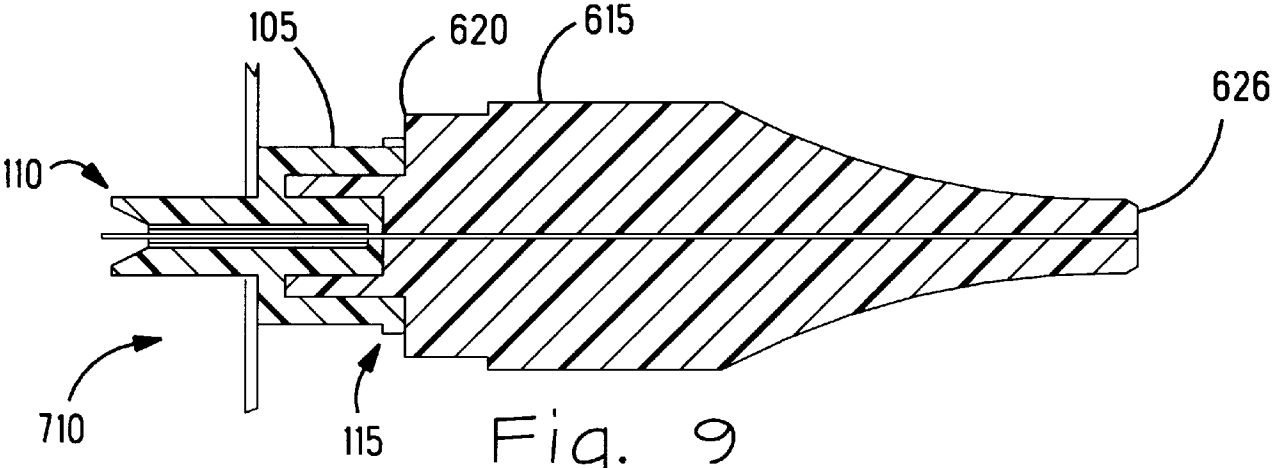
FIG. 9 depicts a cross-sectional view of the system of FIG. 7 along line 9—9.

Referring now to FIGS. 7–9, FIG. 7 illustrates a mating plug connector 610 capable of mating with the connector 100 in accordance with the present invention. The mating plug connector 610 comprises a housing 615 having a first and a second end portion 616, 617, wherein a first interface 620 is located adjacent the first end portion 616 of the housing 615 and a second interface 625 is located adjacent the second end portion 617 of the housing 615.

The first interface 620 includes a contact 630, which, in the illustrated embodiment, comprises a plurality of circular pins (not shown) adapted to interface with corresponding formed contacts 160 (see FIG. 1) of the connector 100. The circular pins (not shown) are recessed into the first end portion 616 of the housing 615. The rectangular shape and size of the first interface 620 is formed in a manner that allows the first interface 620 of the mating plug connector 610 to be inserted into the second interface 125 of the connector 100, as can be seen in FIGS. 8 and 9. A portion 627 of the first interface 620 is removed in a manner that it would positively align with the alignment key 180 of the connector 100 in a single orientation.

A portion 628 of the housing 615 tapers towards the second end portion 617 of the housing 615 to a size that would allow a high-reliability cable (not shown) to be inserted into the second interface 625. The tapered portion 628 of the housing 615 seals and provides added support for the high-reliability cable connection at the second interface 625. The tapered portion 628 of the housing 615 reduces the strain at the second interface 625 and the high-reliability cable (not shown) connection, thereby making it more difficult for the high-reliability cable to accidentally disengage from the mating connector 610. The high-reliability cable (not shown) may be soldered to the contact 630 that runs between the first and second end portions 616, 617 of the mating plug connector 610.

Referring now to FIGS. 8 and 9, FIG. 8 illustrates a system 710 in accordance with the present invention, and FIG. 9 depicts a cross-sectional view of the system of FIG. 8 along line 9—9. The system 710 includes the connector 100 mating with a mating plug connector 610. The plug interface housing 135 of the connector 100 mates with the first interface 620 of the plug connector 610, thereby allowing the formed contacts 160 of the connector 100 to mate with the corresponding pins of the first interface 620 of the mating plug connector 610. Specifically, the first interface 620 of the plug connector will insert into the plug interface housing 175 (see FIG. 1) once the portion 627 of the first interface 620 of the mating plug connector is aligned with the alignment key 180 of the connector 100. The second interface 625 of the mating plug connector 610 may, as an example, be attached to a high-reliability cable (not shown).

The first interface 120 (see FIG. 1) of the connector 100 has the plurality of contacts 160 in the alignment channels 165 and is capable of being electrically connected to a printed circuit board (not shown). The first interface 120 slides onto the printed circuit board in a manner that the plurality of contacts 160 make electrical contact with the printed circuit board.

Figure 10:
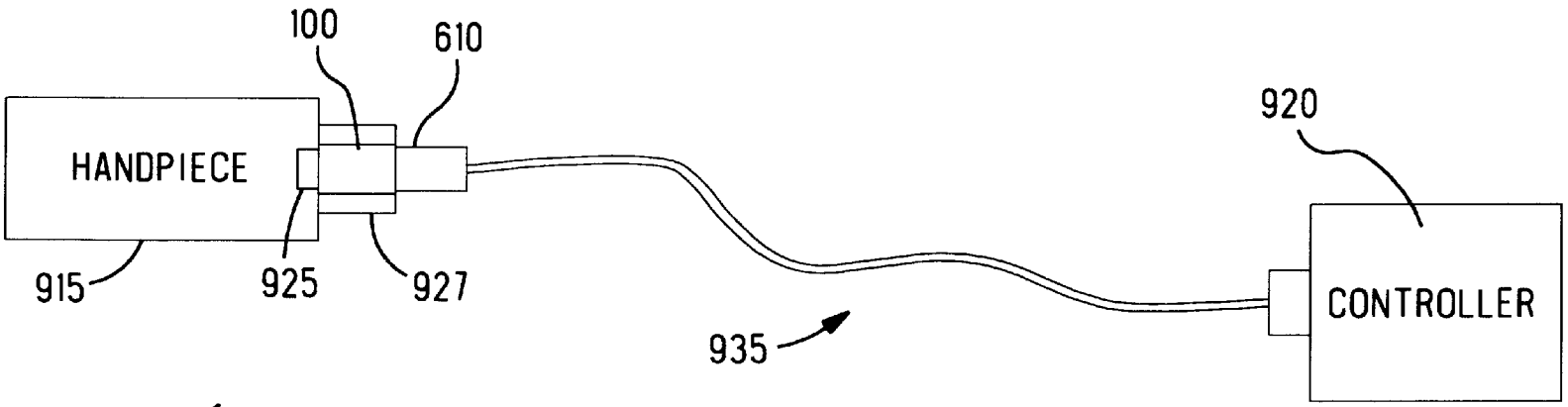
FIG. 10 illustrates an alternative embodiment of a system in accordance with the present invention.

The present invention may be utilized in a variety of applications. However, by the way of illustration only, the use of the present invention in one illustrative application will now be described with reference to FIG. 10, which depicts a alternative embodiment system 910 in accordance with the present invention. Specifically, FIG. 10 illustrates a handpiece 915 coupled to a controller 920 using the connector 100 (see FIG. 1) and mating plug connector 610 (see FIG. 7) of the present invention. The handpiece 915 may be any device having a printed circuit board 925 connection, such as a catheter, a microphone, a video camera, or the like. The controller 920 may be any device capable of interacting with the handpiece 915, including, but not limited to, devices such as a power supply, an amplifier, a video monitor, or recording device. In the illustrated embodiment, the handpiece 915 is a catheter 915.

The catheter 915 includes the printed circuit board 925 that is coupled to the connector 100 via the edge-card interface 105 (see FIG. 1). The connector 100 can be snapped or bonded into a mating handle 927 of the catheter 915, and retained thereafter by the handle interface rib 185 (see FIG. 1). Thus, soldering is not necessary to mate the connector 100 of the present invention with the catheter 915. The connector 100 allows for a low cost transition from the printed circuit board 925 of the catheter 915 to a high reliability cable assembly 935. The connector 100 is connected to the controller 920 via the high reliability cable assembly 935.

For sterilization purposes, the catheter 915 is generally discarded after use. In the illustrated embodiment, the plug connector 610 can be easily disconnected from the connector 100, allowing for a quick and easy means for disposing the catheter 915. Moreover, because the connector 100 of the present invention is a low cost connector, the cost of discarding the connector 100 along with the catheter 915 is reduced substantially. The fact that the plug connector 610 is reusable results in additional savings because the plug connector 610 is not only autoclavable, but also durable.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A system having a cable assembly for connecting a disposable device to a controller, and for separating the disposable device from a mating connector on the cable assembly, further comprising:

a housing of a disposable connector having a plug interface housing portion adapted for connection to, and for disconnection from, said mating connector on said cable assembly;

the disposable connector having electrical contacts extending to said plug interface housing portion;

said housing of the disposable connector being in said disposable device;

the disposable connector having a circuit board interface portion for receiving a circuit board that is adapted for connection to said contacts and to said disposable device;

a projecting, interface abutment encircling said plug interface housing portion;

an interface rib adjacent to said interface abutment, the interface rib connecting to said disposable device, whereby said disposable connector and said disposable device are connected together for disposal together, and said disposable device including a catheter.

2. The system as recited in claim 1, wherein said circuit board interface portion has spaced apart arms for receiving therebetween said circuit board that is adapted for connection to said contacts and to said disposable device.

3. The system as recited in claim 1, wherein said circuit board interface portion is in said disposable device.

4. The system as recited in claim 3, wherein said circuit board interface portion has spaced apart arms for receiving therebetween said circuit board that is adapted for connection to said contacts and to said disposable device.

* * * * *